US007324100B2

(12) United States Patent
Lee

(10) Patent No.: US 7,324,100 B2
(45) Date of Patent: Jan. 29, 2008

(54) PLASMA DISPLAY PANEL WITH ENERGY RECOVERY CIRCUIT AND DRIVING METHOD THEREOF

(75) Inventor: Joo-Yul Lee, Ahsan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 892 days.

(21) Appl. No.: 10/365,247

(22) Filed: Feb. 12, 2003

(65) Prior Publication Data

US 2003/0169243 A1 Sep. 11, 2003

(30) Foreign Application Priority Data

Mar. 5, 2002 (KR) ..... 2002-11647

(51) Int. Cl.
*G09G 5/00* (2006.01)
*G09G 3/28* (2006.01)

(52) U.S. Cl. ..... 345/211; 345/60

(58) Field of Classification Search ..... 345/211, 345/55, 60–72, 204, 212; 315/169.1, 169.3
See application file for complete search history.

(56) References Cited

U.S. PATENT DOCUMENTS 4,866,349 A 9/1989 Weber et al.
5,081,400 A 1/1992 Weber et al.
5,994,929 A * 11/1999 Sano et al. ..... 327/111
6,150,999 A * 11/2000 Chen et al. ..... 345/60
6,480,189 B1 * 11/2002 Ide ..... 345/211
6,538,627 B1 * 3/2003 Whang et al. ..... 345/60
6,583,575 B2 * 6/2003 Roh et al. ..... 315/169.1
6,657,604 B2 * 12/2003 Huang et al. ..... 345/60
6,768,270 B2 * 7/2004 Chae ..... 315/169.3

(Continued)

FOREIGN PATENT DOCUMENTS

CN 1314670 A 9/2001

(Continued)

OTHER PUBLICATIONS

Patent Abstracts of Japan, Publication No. 08-152865; Date of Publication: Jun. 11, 1996; in the name of Masataka Oba et al.

(Continued)

*Primary Examiner*—Amr A. Awad
*Assistant Examiner*—Stephen G Sherman
(74) *Attorney, Agent, or Firm*—Christie, Parker & Hale, LLP

(57) ABSTRACT

A plasma display panel with a driving apparatus including an inductor of which one end is electrically connected to one end of a panel capacitor. The driving apparatus of the plasma display panel alters a terminal voltage of the panel capacitors into a second voltage by storing energy in the inductor using energy of the panel capacitor charged with a first voltage. The terminal voltage of the panel capacitor is changed into the second voltage, and thereafter, it is maintained at the second voltage by freewheeling current flowing through the inductor. In addition, the terminal voltage of the panel capacitor is changed into the first voltage using the energy stored in the inductor. The terminal voltage of the panel capacitor is maintained at the first voltage by connecting one end of the panel capacitor to a first voltage source after it is changed into the first voltage.

22 Claims, 5 Drawing Sheets

U.S. PATENT DOCUMENTS 7,009,823 B2 * 3/2006 Yoon et al. ..... 361/15

FOREIGN PATENT DOCUMENTS

| | | |
|---|---|---|
| JP | 8-152865 | 6/1996 |
| JP | 10-52061 | 2/1998 |
| JP | 10-149135 | 6/1998 |
| JP | 10-301530 | 11/1998 |
| JP | 11-161226 | 6/1999 |
| JP | 11-282416 | 10/1999 |
| JP | 11-352927 | 12/1999 |
| JP | 2000-293131 | 10/2000 |
| JP | 2000-330515 | 11/2000 |
| JP | 2000-338934 | 12/2000 |
| JP | 2001-134233 | 5/2001 |
| JP | 2001-142431 | 5/2001 |
| JP | 2001-184024 | 7/2001 |
| JP | 2001-337640 | 12/2001 |
| JP | 2002-116731 | 4/2002 |

OTHER PUBLICATIONS

Patent Abstracts of Japan, Publication No. 10-052061; Date of Publication: Feb. 20, 1998; in the name of Yoshihiro Matsumoto et al.

Patent Abstracts of Japan, Publication No. 10-149135; Date of Publication: Jun. 2, 1998; in the name of Akihiko Iwata et al.

Patent Abstracts of Japan, Publication No. 10-301530; Date of Publication: Nov. 13, 1998; in the name of Yoshio Sano et al.

Patent Abstracts of Japan, Publication No. 11-161226; Date of Publication: Jun. 18, 1999; in the name of Masayuki Noborio.

Patent Abstracts of Japan, Publication No. 11-282416; Date of Publication: Oct. 15, 1999; in the name of Takashi Hashimoto, et al.

Patent Abstracts of Japan, Publication No. 11-352927; Date of Publication: Dec. 24, 1999; in the name of Yoshio Sano.

Patent Abstracts of Japan, Publication No. 2000-293131; Date of Publication: Oct. 20, 2000; in the name of Koichi Iguchi.

Patent Abstracts of Japan, Publication No. 2000-330515; Date of Publication: Nov. 30, 2000; in the name of Mikio Sasaki, et al.

Patent Abstracts of Japan, Publication No. 2000-338934; Date of Publication: Dec. 8, 2000; in the name of Yasunobu Hashimoto.

Patent Abstracts of Japan, Publication No. 2001-134233; Date of Publication: May 18, 2001; in the name of Shigeo Kiko.

Patent Abstracts of Japan, Publication No. 2001-142431; Date of Publication: May 25, 2001; in the name of Urakabe Takahiro.

Patent Abstracts of Japan, Publication No. 2001-184024; Date of Publication: Jul. 6, 2001; in the name of Takuya Watanabe.

Patent Abstracts of Japan, Publication No. 2001-337640; Date of Publication: Dec. 7, 2001; in the name of Yoshizumi Sekii.

Patent Abstracts of Japan, Publication No. 2002-116731; Date of Publication: Apr. 19, 2002; in the name of Chung-Wook Roh, et al.

* cited by examiner

PLASMA DISPLAY PANEL WITH ENERGY RECOVERY CIRCUIT AND DRIVING METHOD THEREOF

CROSS-REFERENCE TO RELATED APPLICATIONS

This application claims priority to and the benefit of Korean Application No. 2002-0011647, filed on Mar. 5, 2002 in the Korean Intellectual Property Office, the entire disclosure of which is incorporated herein by reference.

BACKGROUND OF THE INVENTION (a) Field of the Invention

The present invention relates to a plasma display panel ("PDP") and a driving method thereof, and more particularly to an energy recovery circuit and a method for driving the same that directly contribute to plasma display discharge.

(b) Description of the Related Art

In recent years, flat panel displays such as liquid crystal displays (LCD), field emission displays (FED), PDPs, and the like have been actively developed. The PDP has advantages over the other flat panel displays because of its high luminance, high luminous efficiency, and wide view angle. Accordingly, the PDP is a preferred large-scale screen of larger than 40 inches that can substitute for the conventional display.

The PDP is a flat panel display that uses plasma generated by gas discharge to display characters or images. It includes, depending on its size, more than several dozens to millions of pixels arranged in a matrix pattern. Such a PDP is classified as a direct current (DC) type or an alternating current (AC) type according to its discharge cell structure and the waveform of the driving voltage applied thereto.

The DC type PDP has electrodes exposed to a discharge space to allow DC to flow through the discharge space while the voltage is applied, and thus requires a resistance for limiting the current. To the contrary, the AC type PDP has electrodes covered with a dielectric layer that forms a capacitor to limit the current and protect the electrodes from the impact of ions during discharge. Thus, the AC type PDP has a longer lifetime than the DC type PDP.

Typically, the driving method of the AC type PDP is composed of a reset step, an addressing step, a sustain step, and an erase step.

In the reset step, the state of each cell is initialized to be ready for addressing the cell. In the addressing step, wall charges are applied in a selected cell that is on the panel (i.e., addressed cell). In the sustain step, a discharge occurs to actually display an image on the addressed cells. In the erase step, the wall charges on the cells are erased to finish the sustained discharge.

In the AC type PDP, the address electrodes for addressing act as a capacitive load, so that there is a capacitance for the electrodes and a need for a reactive power as well as a power for the addressing in order to apply waveforms for addressing. A circuit for recovering the reactive power and reusing it is called an energy recovery circuit.

A conventional energy recovery circuit for the AC type PDP and its driving method are now described.

FIGS. 1 and 2 show a conventional energy recovery circuit and its waveform diagram, respectively.

FIG. 1 shows the energy recovery circuit disclosed in the U.S. Pat. Nos. 4,866,349 and 5,081,400 issued to L. F. Weber.

The conventional energy recovery circuit includes two serially connected switching elements $S_1$ and $S_2$, diodes $D_1$ and $D_2$, inductor $L_C$ and energy recovery capacitor $C_C$, and two serially connected switches $S_3$ and $S_4$.

A contact between the two switching elements $S_3$ and $S_4$ is coupled to the PDP, which is represented by a capacitor $C_P$ in an equivalent circuit.

The conventional energy recovery circuit as constructed above operates in four modes according to the states of the switching elements $S_1$ to $S_2$, and shows the waveforms of output voltage $V_P$ and current $I_L$ flowing to inductor $L_C$, as illustrated in FIG. 2.

Switching element $S_4$ is initially turned on right before switch $S_1$ is turned on, so that terminal voltage $V_P$ of the panel is at zero. In the meantime, energy recovery capacitor $C_C$ is already charged with a voltage ($V_a/2$) that is half address voltage $V_a$.

At t0, while terminal voltage $V_P$ of the panel is maintained at zero, mode 1 begins to turn switching element $S_1$ on and switching elements $S_2$, $S_3$, and $S_4$ off.

In the operational interval (t0 to t1) of mode 1, an $L_C$ resonance path is formed involving energy recovery capacitor $C_C$, switching element $S_1$, diode $D_1$, inductor $L_c$, and plasma panel capacitor $C_P$. Accordingly, current $I_L$ flowing through inductor $L_C$ forms a half waveform because of $L_C$ resonance, and output voltage $V_P$ of the panel gradually increases to address voltage $V_S$. At the moment that output voltage $V_P$ of the panel reaches address voltage $V_S$, almost no current flows to inductor $L_c$.

The mode 2 begins at the end of mode 1, to turn switching elements $S_1$ and $S_3$ on and switches $S_2$ and $S_4$ off. In the operational interval (t1 to t2) of mode 2, externally supplying voltage $V_a$ is applied to panel capacitor $C_P$ via switching element $S_3$ to maintain output voltage $V_P$ of the panel.

Once mode 2 ends in the state of maintaining discharge of terminal voltage $V_P$, mode 3 begins to turn switch $S_2$ on and switches $S_1$, $S_3$,and $S_4$ off.

In the operational interval (t2 to t3) of mode 3, an $L_C$ resonance path is formed in reverse path of the $L_C$ resonance path in mode 1, i.e., a current path including plasma panel capacitor $C_P$, inductor $L_c$, diode $D_2$, switching element $S_2$, and energy recovery capacitor $C_C$ in sequence. Accordingly, as shown in FIG. 2, current $I_L$ flows to inductor $L_c$ and output voltage $V_P$ of the panel falls, so that current $I_L$ of inductor $L_C$ and output voltage $V_P$ of the panel reach zero at t3.

In the operational interval of mode 4, switches $S_2$ and $S_4$ are turned on and switching elements $S_1$ and $S_3$ are turned off to maintain output voltage $V_P$of the panel at zero. Once switching element $S_1$ is turned on in this state, the cycle returns to mode 1.

In the conventional energy recovery circuit configured as above, however, there is a problem that all of the energy is not recovered due to loss of the circuit itself such as ON loss of the switching elements or the switching loss. Thereby, the address voltage cannot be increased to a desired voltage $V_a$ or cannot be decreased to a ground voltage, and this causes a hard-switching of the switching elements. In addition, a rising time and a falling time of the address voltage become longer, and this causes the addressing speed to be lower.

SUMMARY OF THE INVENTION

In accordance with the present invention, energy of a panel capacitor is stored in an inductor, and a terminal voltage of the panel capacitor is increased using the energy.

This provides a reduction inc rising time and falling time of a panel voltage and reduces the number of switching elements.

An energy recovery circuit for a plasma display panel according to the present invention includes a plurality of address electrodes, pairs of a plurality of scan electrodes, a plurality of sustain electrodes intersecting the address electrodes, alternately disposed, and panel capacitors formed among the address electrodes, the scan electrodes and the sustain electrodes.

According to a first aspect of the present invention, the plasma display panel includes a first to a third switching elements, an inductor, and first and second diodes. The first switching element is electrically connected between a first voltage source supplying a first voltage and one end of the panel capacitor, and one end of the second switching element is connected to a contact of the first switching element and the panel capacitor. One end of the inductor is electrically connected to the second switching element and the third switching element is connected between the other end of the inductor and the second voltage source supplying the second voltage. The first diode is connected between the other end of the inductor and the contact of the first switching element and the panel capacitor, and the second diode is connected between the second voltage source and a contact of the second switching element and the inductor.

In this case, the energy recovery circuit according to the first aspect of the present invention may further include a third diode connected between the second switching element and the inductor.

According to a second aspect of the present invention, a driving apparatus is provided, which includes an inductor of which one end is electrically connected to one end of a panel capacitor. The driving apparatus of the plasma display panel alters a terminal voltage of the panel capacitor into a second voltage by storing energy in the inductor using energy of the panel capacitor charged with a first voltage. In addition, it alters the terminal voltage thereof into the first voltage using the energy stored in the inductor. The terminal voltage thereof is preferably maintained at the second voltage by freewheeling current flowing through the inductor after it is changed into the second voltage.

In this case, the driving apparatus may further includes at least one diode electrically connected between the inductor and a second voltage source in order to freewheel current. Furthermore, the driving apparatus preferably maintains the terminal voltage of the panel capacitor at the first voltage by connecting one end of the panel capacitor to a first voltage source after the terminal voltage thereof is changed into the first voltage. The driving voltage may further include a switching element electrically connected between the first voltage source and the panel capacitor to perform a switching operation in order to maintain the terminal voltage thereof at the first voltage.

When the plasma display panel according to the present invention operates, a first to a fourth current paths are formed. The first current path is formed between one end of the panel capacitor and the second voltage source to store energy in the inductor and to simultaneously decrease a terminal voltage to the second voltage from the first voltage. The second current path includes a first diode for freewheeling current flowing through the inductor in order to maintain energy stored in the inductor. The third current path increases the terminal voltage of the panel capacitor to the first voltage from the second voltage by the energy stored in the inductor. The fourth current path is formed between the first voltage source and one end of the panel capacitor to maintain the terminal voltage of the panel capacitor at the first voltage.

A method of driving the plasma display panel according to the present invention includes: a first step of altering a terminal voltage into a second voltage using energy of the panel capacitor charged with a first voltage in storing energy in an inductor connected to the panel capacitor; a second step of maintaining the terminal voltage of the panel capacitor at the second voltage; a third step of altering the terminal voltage of the panel capacitor into the first voltage again using energy stored in the inductor; and a fourth step of maintaining the terminal voltage at the first voltage.

A method of driving a plasma display panel having the driving apparatus according to the first aspect is provided. The method includes: a first step of turning the first switching element OFF and the second and the third switching element ON to alter the terminal voltage of the panel capacitor into the second voltage and to store energy in the inductor in a state of maintaining the terminal voltage of the panel capacitor at the first voltage; a second step of maintaining the terminal voltage of the panel capacitor at the second voltage by allowing the current flowing through the inductor to flow through the third switching element and the second diode; a third step of altering the terminal voltage of the panel capacitor into the first voltage by allowing the current flowing through the inductor to flow to the panel capacitor; and a fourth step of maintaining the terminal voltage of the panel capacitor at the first voltage by turning on the first switching element.

In this case, an interval that the third switching element is turned on is shorter than an interval that the first switching element is turned on.

DETAILED DESCRIPTION

Figure 1:
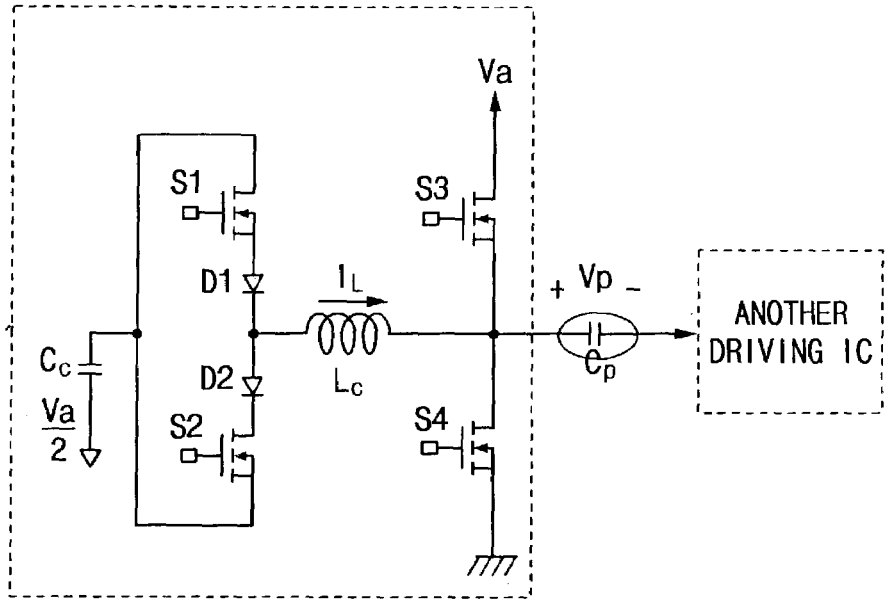
Fig. 1 (Prior Art)
FIG. 1 illustrates an energy recovery circuit according to the prior art.
Figure 2:
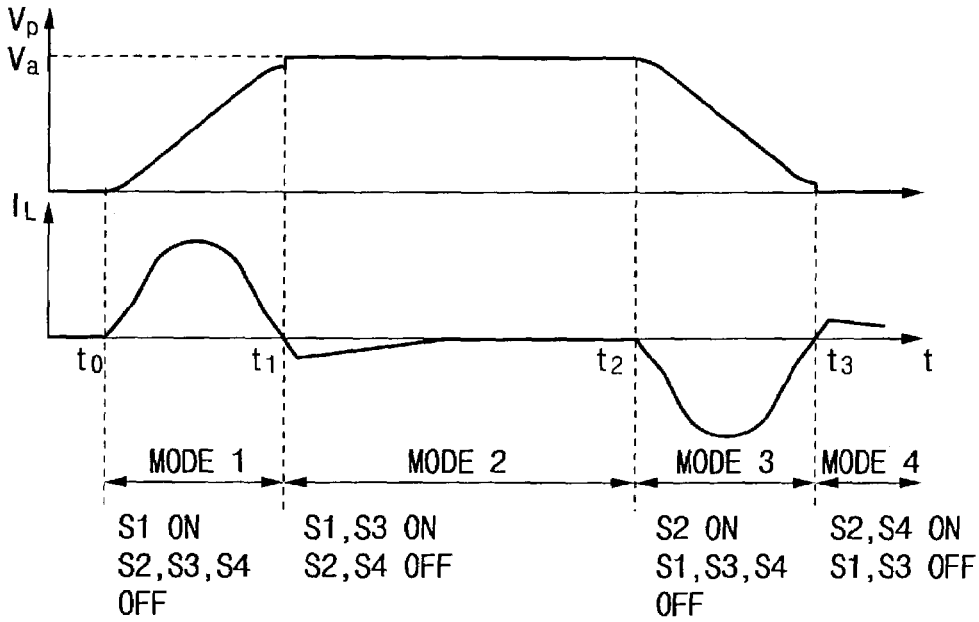
Fig. 2 (Prior Art)
FIG. 2 illustrates operational timing in the energy recovery circuit according to the prior art.

In the drawings, the parts with no relation to the description will be omitted for clarity. Like numerals refer to like elements throughout. It will be understood by those skilled in the art that when an element is referred to as "connection with" another element, it can be directly connected with the other element or intervening elements may also be present electrically.

Figure 3:
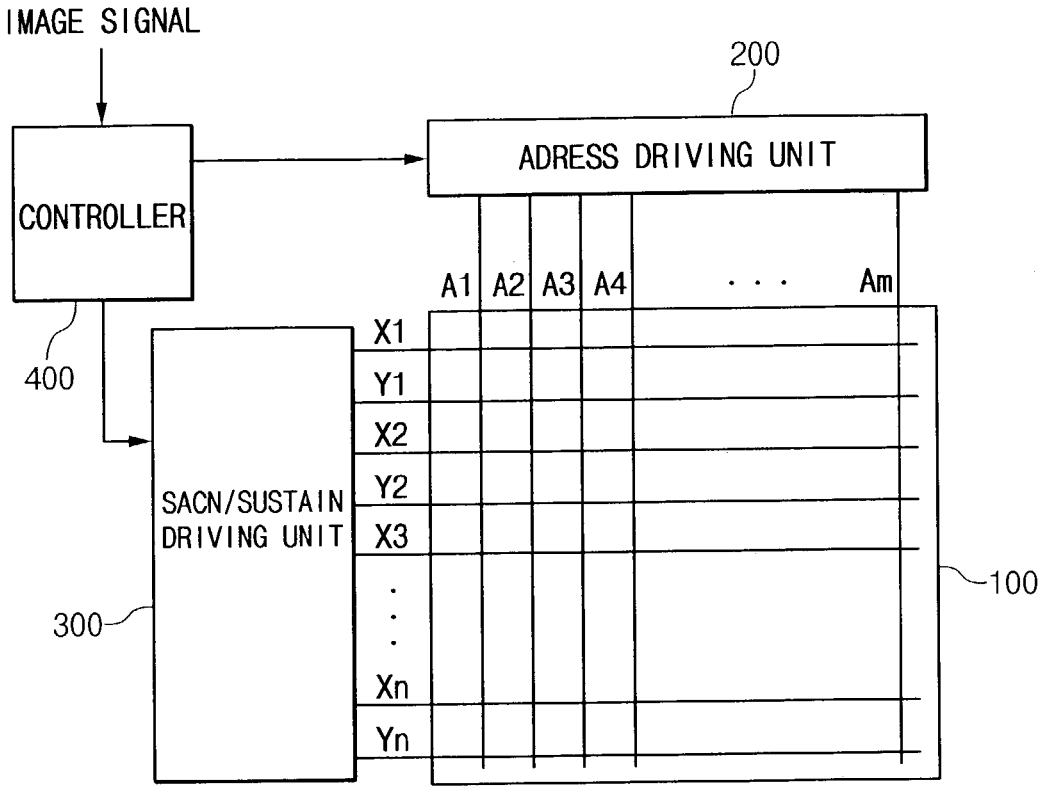
FIG. 3 illustrates a plasma display panel according to an embodiment of the present invention.

First, referring to FIG. 3, the plasma display panel according to an embodiment of the present invention will be described. As shown in FIG. 3, the plasma display panel includes plasma panel 100, address driving unit 200, scan/sustain driving unit 300, and controller 400.

Plasma panel 100 includes a plurality of address electrodes A1 to Am disposed in a longitudinal direction, and a plurality of scan electrodes Y1 to Yn and a plurality of sustain electrodes X1 to Xn alternately disposed in a transverse direction. X electrodes X1 to Xn are formed corresponding to Y electrodes Y1 to Yn, and typically, and ends thereof are commonly connected with each other.

Address driving unit 200 includes an energy recovery circuit, which receives an address driving control signal from controller 400 to apply a display data signal for selecting a discharge cell desired to be displayed to each address electrode and recovers a reactive power and reuses it.

Scan/sustain driving unit 300 receives a sustain discharge signal from controller 400 to input a sustain pulse voltage to the scan electrodes and the sustain electrodes alternately, thereby performing a sustain discharge for the selected discharge cell.

Controller 400 receives an image signal from an external device to generate the address driving control signal and the sustain discharge signal, thereby, applying them to address driving unit 200 and scan/sustain driving unit 300, respectively.

Figure 4:
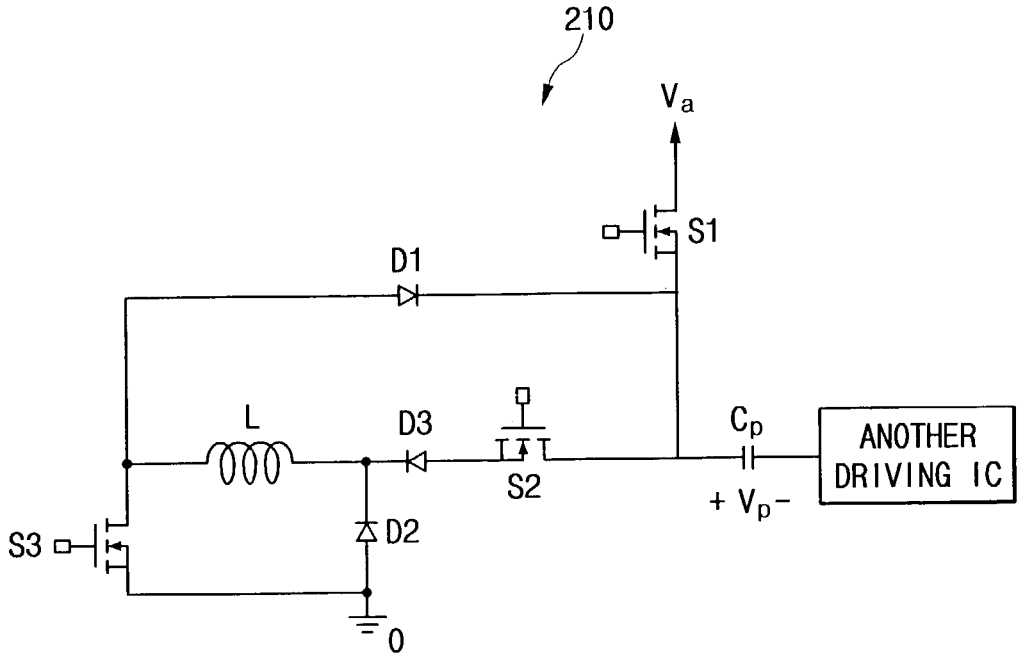
FIG. 4 illustrates an energy recovery circuit according to an embodiment of the present invention.

Hereinafter, referring to FIGS. 4 to 6, energy recovery circuit 210 according to an embodiment of the present invention, included in address driving unit 200, will be described. As shown in FIG. 4, energy recovery circuit 210 is connected to one electrode of a panel (hereinafter, referred to as "panel capacitor Cp") intervening an address driving IC (not shown). The other electrode is connected to another driving IC, i.e., a scan driving IC or a sustain driving IC.

A description will be made assuming that energy recovery circuit 210 is connected to panel capacitor Cp, omitting address driving IC.

Energy recovery circuit 210 includes inductor L, switching elements S1, S2, and S3 and diodes D1 and D2. Switching element S1 is connected between address voltage Va and one electrode of panel capacitor Cp, and switching element S2 and inductor L are in series connected to one electrode of panel capacitor CP.

Diode D1 is connected between one end of the inductor, not connected to switching element S2, and one electrode of panel capacitor Cp to form a current path. And, switching element S3 and diode D2 are connected between both terminals of the inductor and a ground voltage to form a freewheeling path of a current.

In addition, power recovery circuit 210 may further include diode D3 for setting a current path from panel capacitor Cp to inductor L.

Next, referring to FIGS. 5A to 5D and FIG. 6, a method of driving the plasma display panel according to an embodiment of the present invention will be described.

Figure 5A:
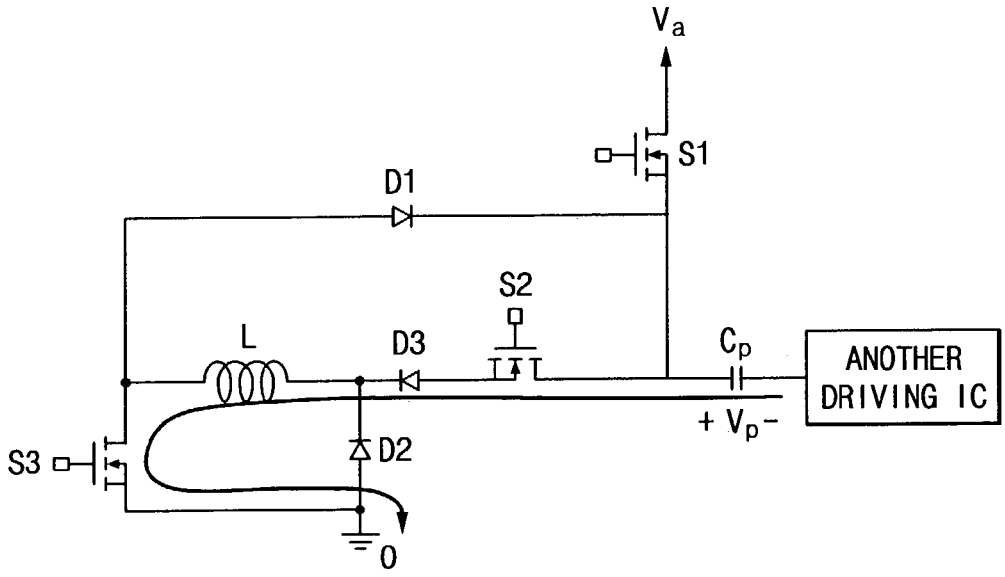
FIG. 5A to FIG. 5D illustrate current paths at respective modes in the energy recovery circuit according to an embodiment of the present invention.
Figure 5B:
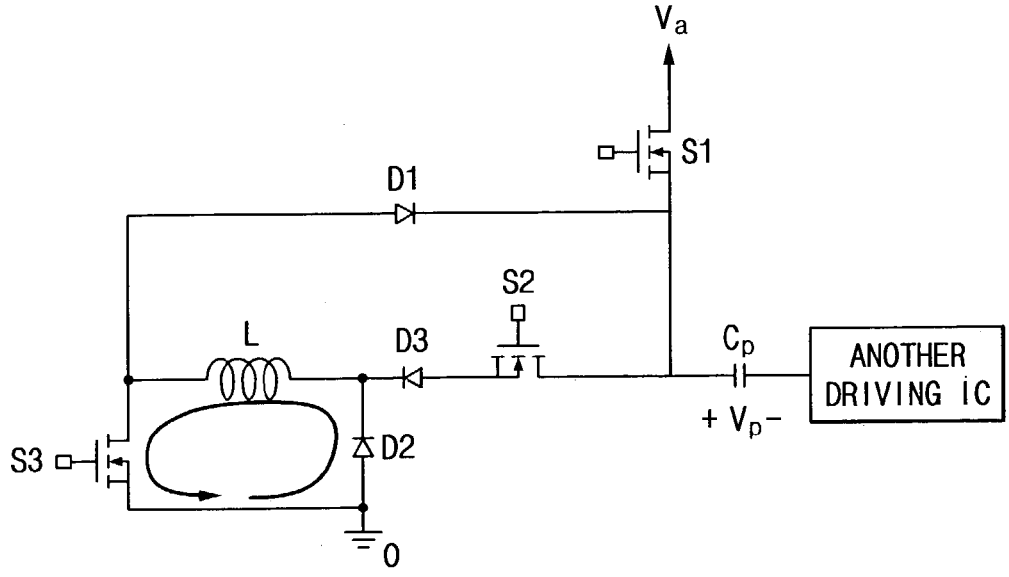
Figure 5C:
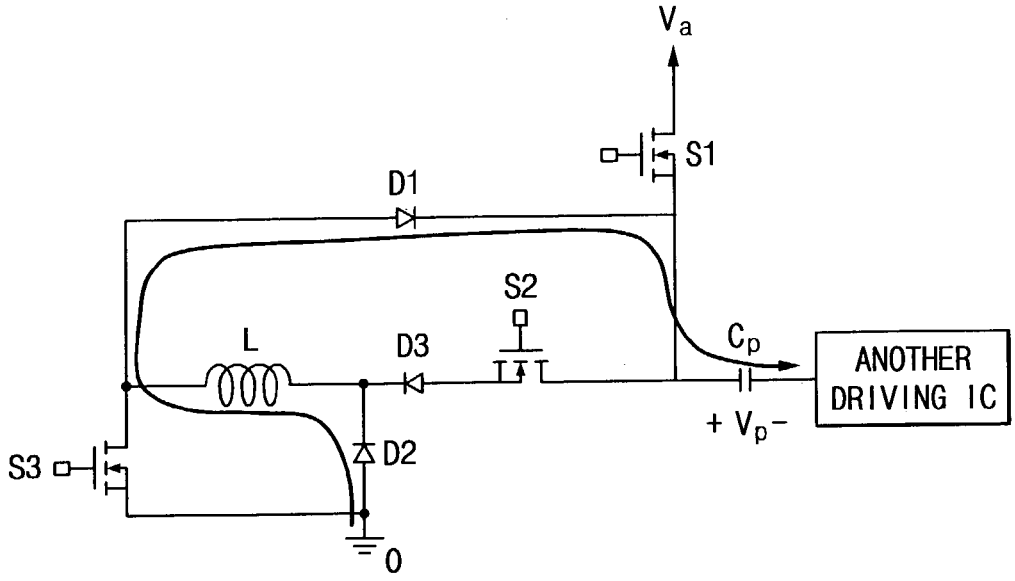
Figure 5D:
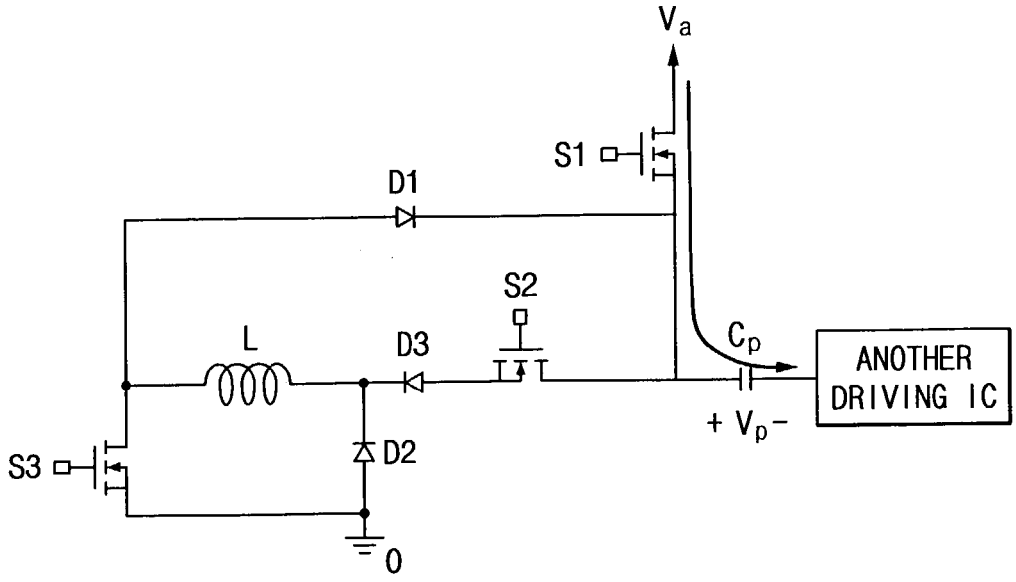
Figure 6:
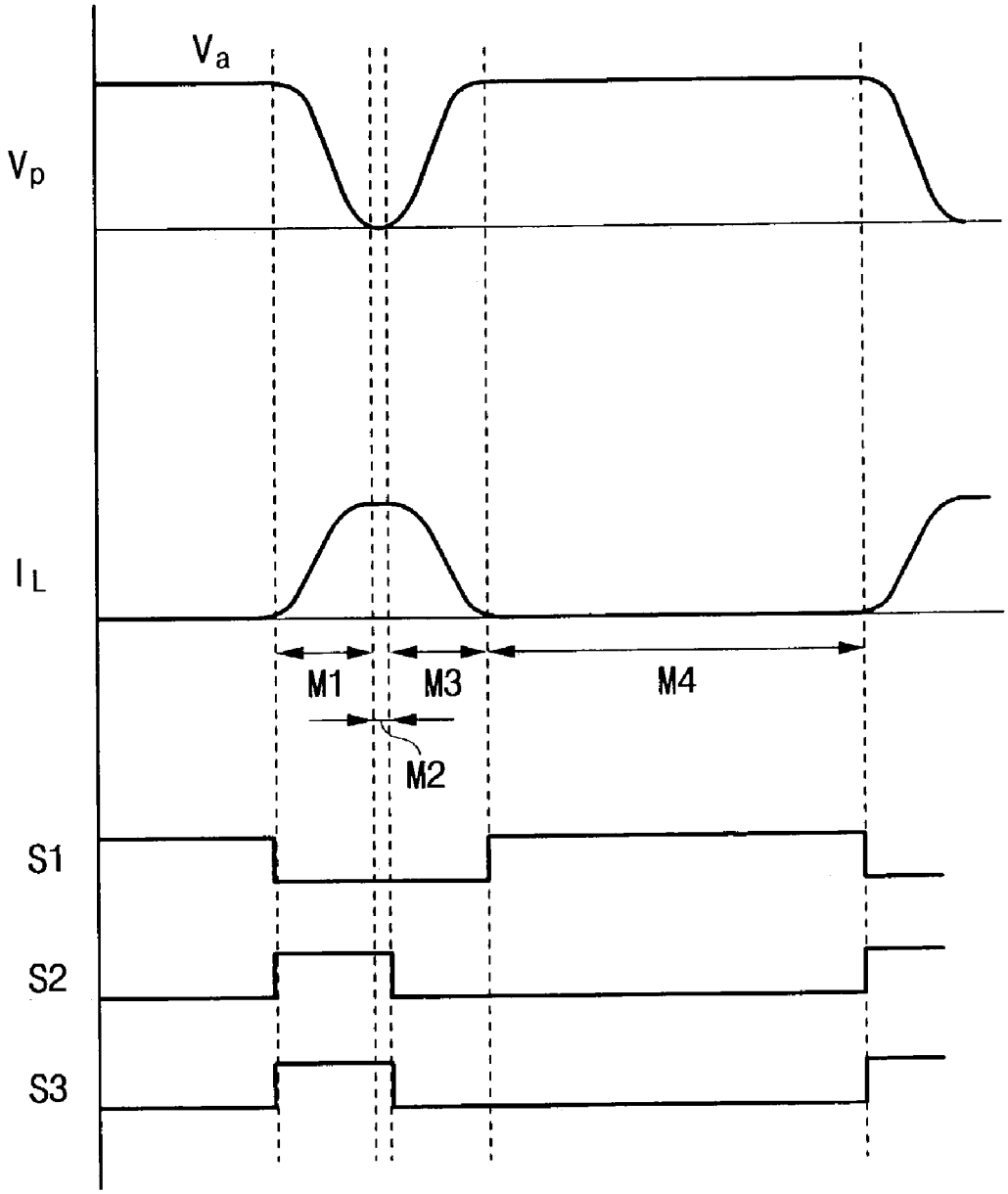
FIG. 6 illustrates operational timing in the energy recovery circuit according to an embodiment of the present invention.

FIGS. 5A to 5D illustrate current paths of respective modes in the energy recovery circuit and FIG. 6 illustrates the operational timing in the energy recovery circuit. Assuming that switching element S1 is turned on before mode 1 starts, and thus, terminal voltage Vp of panel capacitor Cp is maintained at address voltage Vs.

(1) Mode 1 (M1)

Referring to interval M1 of FIG. 5A and FIG. 6, the operation of mode 1 will be described.

At interval M1, switching element S1 is turned off and switching elements S2 and S3 are turned on. Then, a current path is formed involving panel capacitor Cp, switching element S2, diode D3, inductor L and switching element S3. By this current path, terminal voltage Vp of panel capacitor Cp is decreased from address voltage Va to the ground voltage, and the current flowing through inductor L is increased, and thereby, the energy is stored in the inductor. That is, the energy stored in panel capacitor Cp is stored in inductor L.

(2) Mode 2 (M2)

Referring to interval M2 of FIG. 5B and FIG. 6, the operation of mode 2 will be described.

Once terminal voltage Vp of panel capacitor Cp is decreased to the ground voltage, it is no longer decreased due to diode D2 and is maintained at the ground voltage. In addition, current IL flowing through inductor L is freewheeled in a path of inductor L, switching element S3 and diode D2. In this case, current IL becomes the maximum, and shorter the period more advantageous it is.

(3) mode 3 (M3)

Referring to interval M3 of the FIG. 5C and FIG. 6, the operation of mode 3 will be described.

At interval M3, switching elements S2 and S3 are turned off in a state of turn-off of switching element S1. Since switching element S2 is not included in the current path at mode 2, it may be turned off at mode 2 M2. The turn-off of switching element S3 allows current IL to flow in a path of diode D2, inductor L, diode D1, and panel capacitor Cp, thereby increasing terminal voltage Vp of the panel capacitor. When inductor current IL is at zero, terminal voltage Vp of panel capacitor Cp is no longer increased and is maintained at address voltage Va.

At interval M3, terminal voltage Vp of the panel capacitor is increased by storing the energy stored in the inductor, using the energy stored in panel capacitor Cp at mode 1.

(4) Mode 4 (M4)

Referring to M4 interval of FIG. 5D and FIG. 6, the operation of mode 4 will be described.

At interval M4, switching element S1 is turned on in a state of increase of terminal voltage Vp of panel capacitor Cp to address voltage Va. Once switching element S1 is turned on, terminal voltage Vp of panel capacitor Cp can be maintained at the address voltage by a path of the address voltage Va, the switching element S1 and the panel capacitor Cp.

Next, the process of mode 1 to mode 4 is repeated to make terminal voltage Vp of panel capacitor Cp to alter address voltage Va and the ground voltage repeatedly.

According to the embodiment of the present invention, the energy is stored in inductor L using the energy charged in capacitor Cp, and terminal voltage Vp of panel capacitor Cp can be increased again using the energy stored in inductor L.

According to the present invention, the number of the switching elements and the diodes is reduced by one each, compared with the prior art, and also, there is no need for an external capacitor. In other words, a configuration of a circuit is simplified compared with the prior art. Since the energy is stored in only inductor L without using an external capacitor to perform charging/discharging, terminal voltage Vp of panel capacitor Cp can be rapidly increased to address voltage Va and rapidly decreased to 0V to decrease a rising time and a falling time. As it takes a shorter time to recover the address voltage again after the voltage of the panel capacitor is decreased to 0V, as above, a time that the voltage is maintained at high potential becomes longer, and thus, a discharging characteristic of the plasma display panel becomes better.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An energy recovery circuit for a plasma display panel having a plurality of address electrodes and pairs of scan electrodes and sustain electrodes intersecting the address electrodes and alternately disposed, and panel capacitors formed among the address electrodes, the scan electrodes and the sustain electrodes, the energy recovery circuit comprising:

a first switching element coupled between a first power source supplying a first voltage and one end of a panel capacitor;

a second switching element, one end of the second switching element being coupled to a contact of the first switching element and the panel capacitor;

an inductor, one end of the inductor being coupled to one end of the panel capacitor;

a first diode coupled between an other end of the inductor and the contact of the first switching element and the panel capacitor;

a second diode coupled between a second power source supplying a second voltage and a contact of the second switching element and the inductor; and a third switching element coupled between the other end of the inductor and the second power source.

2. The energy recovery circuit of claim 1, further comprising a third diode coupled between the second switching element and the inductor.

3. The energy recovery circuit of claim 1, wherein the first voltage is an address voltage and the second voltage is a ground voltage.

4. A method of driving a plasma display panel having the driving apparatus described in claim 1, the method comprising:

(a) turning the first switching element OFF and the second and the third switching elements ON to alter the terminal voltage of the panel capacitor into the second voltage and to store energy in the inductor, in a state of maintaining the terminal voltage of the panel capacitor at the first voltage;

(b) maintaining the terminal voltage of the panel capacitor at the second voltage by allowing the current flowing through the inductor to flow through the third switching element and the second diode;

(c) altering the terminal voltage of the panel capacitor into the first voltage by allowing the current flowing through the inductor to flow to the panel capacitor; and (d) maintaining the terminal voltage of the panel capacitor at the first voltage by turning on the first switching element.

5. The method of claim 4, wherein the second switching element is turned off in the step (b) or (c).

6. The method of claim 4, wherein an interval that the third switching element is turned on is shorter than an interval that the first switching element is turned on.

7. The method of claim 4, wherein the first voltage is an address voltage and the second voltage is a ground voltage.

8. A driving apparatus for an address driving unit of a plasma display panel having a plurality of address electrodes and pairs of scan electrodes and sustain electrodes intersecting the address electrodes and alternately disposed, panels having panel capacitors formed among the address electrodes, the scan electrodes and the sustain electrodes, and driving apparatus for driving the panels, the driving apparatus comprising:

an inductor, one end of the inductor being coupled to one end of a panel capacitor, wherein the driving apparatus alters a terminal voltage of the panel capacitor into a second voltage by storing energy in the inductor using energy of the panel capacitor, freewheels current flowing through the inductor while the terminal voltage of the panel capacitor is maintained at the second voltage, and alters the terminal voltage of the panel capacitor into a first voltage using the current freewheeled through the inductor.

9. The driving apparatus of claim 8, further comprising at least one diode coupled between the inductor and a second voltage source so that the current freewheels.

10. The driving apparatus of claim 8, wherein the terminal voltage of the panel capacitor is maintained at the first voltage by coupling one end of the panel capacitor to a first voltage source after the terminal voltage of the panel capacitor is changed into the first voltage.

11. The driving apparatus of claim 10, further comprising a switching element coupled between the first voltage source and the panel capacitor to perform a switching operation in order to maintain the terminal voltage of the panel capacitor at the first voltage.

12. The driving apparatus of claim 8, further comprising a switching element coupled between the one end of the panel capacitor and one end of the inductor to perform a switching operation in order to store energy stored in the panel capacitor in the inductor.

13. The driving apparatus of claim 8, wherein the first voltage is an address voltage and the second voltage is a ground voltage.

14. A driving apparatus for an address driving unit of a plasma display panel having a plurality of address electrodes and pairs of scan electrodes and sustain electrodes intersecting the address electrodes and alternately disposed, panels having panel capacitors formed among the address electrodes, the scan electrodes and the sustain electrodes, and driving apparatus for driving the panels, the driving apparatus comprising:

an inductor, one end of the inductor being coupled to one end of a panel capacitor; and a diode coupled between the other end of the inductor and one end of the panel capacitor to form current path of the inductor to the panel capacitor;

wherein the driving apparatus alters a terminal voltage of the panel capacitor into a second voltage by storing energy in the inductor using energy of the panel capacitor, freewheels current flowing through the inductor while the terminal voltage of the panel capacitor is maintained at the second voltage, and alters the terminal voltage of the panel capacitor into a first voltage using the current freewheeled through the inductor.

15. A method of driving a plasma display panel having a plurality of address electrodes and pairs of scan electrodes and sustain electrodes intersecting the address electrodes and alternately disposed, and panels having panel capacitors formed among the address electrodes, the scan electrodes and the sustain electrodes, the method comprising:

(a) altering a terminal voltage into a second voltage using energy of a panel capacitor charged with a first voltage in storing energy in an inductor coupled to the panel capacitor;

(b) maintaining the terminal voltage of the panel capacitor at the second voltage such that while the terminal voltage of the panel capacitor is maintained at the second voltage, current is freewheeled through the inductor;

(c) altering the terminal voltage of the panel capacitor into the first voltage again using the current freewheeled through the inductor; and (d) maintaining the terminal voltage at the first voltage.

16. The method of driving the plasma display panel of claim 15, wherein the step (b) freewheels the current through the inductor and a diode.

17. The method of driving the plasma display panel of claim 15, wherein the step (d) maintains the terminal voltage of the panel capacitor at the first voltage by coupling one end of the panel capacitor to a first voltage source.

18. An energy recovery circuit for a plasma display panel having panel capacitors, comprising:

a first voltage source and a second voltage source supplying a first voltage and a second voltage, respectively, and an inductor coupled to one end of a panel capacitor;

a first current path formed between one end of the panel capacitor and the second voltage source to store energy in the inductor and to simultaneously decrease a terminal voltage to the second voltage from the first voltage;

a second current path including a first diode for freewheeling current flowing through the inductor in order to maintain energy stored in the inductor;

a third current path increasing the terminal voltage of the panel capacitor to the first voltage from the second voltage by the energy stored in the inductor; and a fourth current path formed between the first voltage source and one end of the panel capacitor to maintain the terminal voltage of the panel capacitor at the first voltage.

19. The energy recovery circuit of claim 18, wherein the third current path comprises a second diode connected between the inductor and one end of the panel capacitor.

20. A plasma display panel comprising:

a plasma panel having a plurality of address electrodes and pairs of scan electrodes and sustain electrodes intersecting the address electrodes and alternately disposed, and panel capacitors formed among the address electrodes, the scan electrodes and the sustain electrodes;

a controller which receives an image signal from an external device to generate an address driving control signal and a sustain discharge signal;

an address driving unit which receives the address driving control signal from the controller to apply a display data signal for selecting a discharge cell desired to be displayed to each address electrode; and a scan/sustain driving unit which receives the sustain discharge signal from the controller to input a sustain pulse voltage to the scan electrodes and the sustain electrodes alternately, thereby performing a sustain discharge for the selected discharge cell;

the address driving unit having an energy recovery circuit for recovering a reactive power and reusing it, the energy recovery circuit including:

a first switching element coupled between a first power source supplying a first voltage and one end of a panel capacitor;

a second switching element, one end of the second switching element being coupled to a contact of the first switching element and the panel capacitor;

an inductor, one end of the inductor being coupled to one end of the panel capacitor;

a first diode coupled between an other end of the inductor and the contact of the first switching element and the panel capacitor;

a second diode coupled between a second power source supplying a second voltage and a contact of the second switching element and the inductor; and a third switching element coupled between the other end of the inductor and the second power source.

21. The plasma display panel of claim 20, wherein the energy recovery circuit includes a third diode coupled between the second switching element and the inductor.

22. The plasma display panel of claim 20, wherein the first voltage is an address voltage and the second voltage is a ground voltage.

* * * * *